United States Patent [19]

Boers et al.

[11] Patent Number: 5,052,624

[45] Date of Patent: Oct. 1, 1991

[54] ULTRA HIGH PRESSURE WATER CLEANING TOOL

[75] Inventors: Arie N. Boers, Plymouth; Eric J. Chalmers, Minneapolis, both of Minn.

[73] Assignee: Possis Corporation, Minneapolis, Minn.

[21] Appl. No.: 444,288

[22] Filed: Dec. 1, 1989

Related U.S. Application Data

[63] Continuation-in-part of Ser. No. 166,608, Mar. 11, 1988.

[51] Int. Cl.[5] ..... B05B 9/01

[52] U.S. Cl. ..... 239/525; 239/532; 239/599

[58] Field of Search ..... 239/525, 526, 597–599, 239/568, 532

[56] References Cited

U.S. PATENT DOCUMENTS

| | | | |
|---|---|---|---|
| 25,916 | 8/1896 | Woods . | |
| 257,740 | 12/1980 | Humphrey, II et al. . | |
| 280,125 | 8/1985 | Butterfield et al. . | |
| 1,744,208 | 1/1930 | Buchanan | 239/597 X |
| 1,813,733 | 7/1931 | Freeman | 239/597 |
| 1,897,683 | 2/1933 | Tracy | 239/597 |
| 1,940,171 | 12/1933 | Huss . | |
| 2,116,863 | 5/1938 | Dinley | 239/594 |
| 2,127,883 | 8/1938 | Norton . | |
| 3,203,736 | 12/1961 | Anderson . | |
| 3,437,274 | 4/1969 | Apri . | |
| 3,488,006 | 1/1970 | Gigantino . | |
| 3,514,037 | 1/1968 | McDonald . | |
| 3,536,151 | 10/1968 | Aarup . | |
| 3,750,961 | 8/1973 | Franz . | |
| 3,756,106 | 9/1973 | Chadwick et al. . | |
| 3,832,069 | 8/1974 | Petsch . | |
| 3,885,739 | 5/1975 | Tuttle | 239/526 |
| 4,097,000 | 6/1978 | Derr | 239/599 |
| 4,103,830 | 8/1978 | Roth | 239/599 X |
| 4,151,686 | 5/1979 | Lee et al. | 264/332 |
| 4,176,793 | 12/1979 | Heinrich | 239/526 X |
| 4,216,911 | 8/1980 | Huperz | 239/526 |
| 4,244,521 | 1/1981 | Guse | 239/600 X |
| 4,346,849 | 8/1982 | Rood | 239/597 |
| 4,363,335 | 12/1982 | Tapper . | |
| 4,618,101 | 10/1986 | Piggott . | |
| 4,718,067 | 1/1988 | Levine | 239/597 |

FOREIGN PATENT DOCUMENTS

| | | | |
|---|---|---|---|
| 989083 | 4/1949 | France | 239/597 |

*Primary Examiner*—Andres Kashnikow
*Assistant Examiner*—Kevin Weldon
*Attorney, Agent, or Firm*—Burd, Bartz & Gutenkauf

[57] ABSTRACT

An ultra high pressure water tool has a nozzle assembly equipped with a fan tip that discharges a relatively flat stream of ultra high pressure water to a surface to remove coatings and flashings. The fan tip has a body containing an elongated passage and a layer of super hard material having an elongated discharge orifice open to the passage.

43 Claims, 6 Drawing Sheets

ULTRA HIGH PRESSURE WATER CLEANING TOOL

CROSS REFERENCE TO RELATED APPLICATION

This application is a continuation-in-part of U.S. application Ser. No. 166,608 filed Mar. 11, 1988.

TECHNICAL FIELD

The invention is an ultra high pressure waterjet demolition and cleaning tool. The tool is a portable hand held lance equipped with a nozzle assembly having a fan tip to dispense a relatively flat pattern of ultra high pressure water to a surface or an object.

BACKGROUND OF THE INVENTION

Water under pressure discharged from nozzles mounted on hand held guns is commonly used to clean surfaces as floors, walls and equipment and cut into concrete and soil. Guns having elongated tubes carrying water under pressure to nozzles which direct streams of water to selected locations are used to clean surfaces and objects. Examples of guns having nozzles for directing one or more streams of water under pressure to a selected location are shown by Andersen in U.S. Pat. No. 3,203,736, McDonald in U.S. Pat. No. 3,514,037 and Aarup in U.S. Pat. No. 3,536,151. These water cleaning systems use relatively low water pressure which does not erode the nozzle structure. Some of the nozzles are provided with transverse V-grooves to provide the nozzle with a broad or generally flat spray pattern. When these types of nozzles are used in ultra high water pressure systems, such as water pressure of 25,000 to 100,000 psi, the rapidly moving ultra high pressure water will erode the nozzle and substantially increase the orifice size. This makes the nozzle ineffective as an excessive amount of water flows through the orifice making it difficult for the pumping sysem to maintain the ultra high water pressure and substantially reducing the cutting and cleaning efficiency of the cleaning system.

SUMMARY OF THE INVENTION

The invention is directed to an ultra high pressure water cleaning tool having a nozzle assembly used to remove coatings and flashings from surfaces and objects. The nozzle assembly is equipped with a fan tip that produces one or more relatively flat streams of ultra high pressure water. The water is discharged through a relatively small orifice as a relatively flat sheet of water having uniform distribution of water flow. The size of the orifice is maintained over a substantial period of time. One embodiment of the nozzle assembly includes a fan tip having a layer of super hard material surrounding the orifice whereby material erosion due to ultra high pressure water flowing through the orifice is minimal.

A preferred embodiment of the tool has an elongated tubular member having an inlet end and an outlet end. A solenoid actuated valve remotely coupled to the inlet end controls the flow of ultra high pressure water into the tubular member. A trigger mounted on the tubular member has a switch electrically coupled to the solenoid so that when the trigger is pulled the solenoid is actuated to allow ultra high pressure water to flow through the tubular member and a nozzle assembly mounted on the outlet end of the tubular member.

When the trigger is released the switch opens so that the solenoid acts to close the remote valve to terminate the supply of ultra high pressure water to the hose connected to the tubular member.

The nozzle assembly has a head with an internal chamber, an external recess open to the chamber, and an annular lip between the chamber and external recess. A fan tip is retained in the chamber adjacent the annular lip with an annular ring, such as an O-ring. The O-ring surrounds the fan tip and holds it in tight engagement with the head. One embodiment of the fan tip has an elongated passage intersected with a transverse slot forming a discharge orifice for ultra high pressure water which is directed as a generally flat stream of water toward a selected location. The slot and orifice are in hard metal which has long wear life and maintains the dimensions of the orifice to provide an energy efficient and uniform stream of water. Another embodiment of the fan tip has a layer of super hard material, such as polycrystalline diamond, cubic boron nitride, or borazon, bonded to a base. An elongated oval orifice in the super hard material and base establishes a uniform general flat stream of ultra high pressure water that is directed to a selected location.

The nozzle assembly in one embodiment has an angularly adjustable head used to change the orientation of the generally flat streams of ultra high pressure water. Another embodiment of the nozzle assembly has a body supporting a pair of nozzle units. Each nozzle unit has a sleeve accommodating a fan tip. The sleeve is threaded into the body so that it can be removed from the body to allow the fan tip to be replaced.

DESCRIPTION OF PREFERRED EMBODIMENTS

Figure 1:
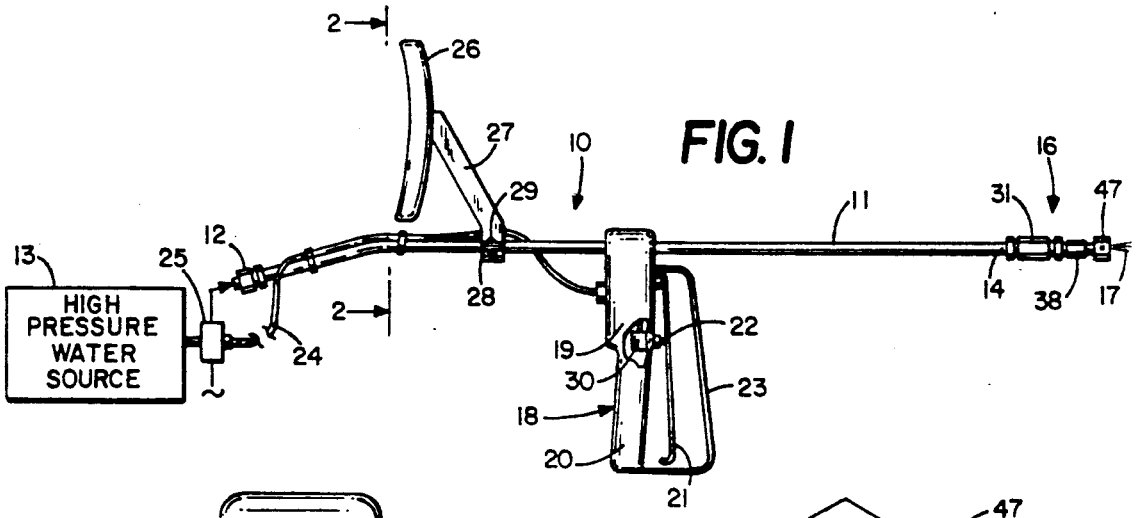
FIG. 1 is a side view of an ultra high pressure water lance equipped with a nozzle assembly having a fan tip.

Referring to FIG. 1, there is shown an ultra high pressure water demolition and cleaning tool or lance of the invention indicated, generally at 10 for cleaning and scarification applications. Ultra high pressure water is water under pressure of at least 25,000 psi. For example, tool 10 is used to remove coatings, such as paint and oils, and flashings from surfaces and objects. Tool is a light-weight, hand held apparatus that is manually manipulated to direct a generally flat stream or curtain of ultra high pressure water toward a surface for cleaning and removing objects and coatings from the surface.

Tool 10 has an elongated rigid pipe or tubular member 11 of metal. Pipe 11 has an inlet end 12 connected to an ultra high pressure water source 13 with a hose. A power driven pump can be used to provide a supply of water under pressure of at least 25,000 psi. An intensifier can be used to elevate the pressure of the water from the range of 25,000 psi to over 100,000 psi. A remote control valve 25 is interposed in the line or hose that connects the ultra high pressure water source 13 to inlet end 12. Remote control valve 25 is an electrically operated valve, such as a solenoid valve, that utilizes low voltage to control the supply of ultra high pressure water to pipe 11.

Pipe 11 has an outlet end 14 attached to a nozzle assembly indicated generally at 16. Nozzle assembly 16 is used to establish a generally flat stream or curtain of water under ultra high pressure that is directed to a selected location by the operator of the tool. The configuration of the generally flat water stream 17 is maintained over a substantial period of time as nozzle assembly 16 has a minimum of material erosion. Nozzle assembly 16 has an orifice 61 that controls the dimensions and pattern of the stream of water to provide uniform distribution of water flow. The results are a high quality uniform stream of water and efficient use of pumping energy.

Tool 10 is manually controlled by the operator with the use of a trigger mechanism indicated generally at 18 and a shoulder rest 26. Trigger mechanism 18 has a body 19 that is secured to the mid-portion of pipe 11. The lower portion of body 19 has a downwardly extended hand grip 20. A movable member or pivotally mounted lever 21 is located on the front side of body 19 and grip 20. Lever 21 engages an actuator 22 for an electrical switch 30 located within body 19. Switch 30 is connected with an electrical cord or line 24 to the electrical controls for remote control valve 25. A guard 23 extended from the upper portion of body 19 in front of lever 21 is secured at its lower end to the bottom of hand grip 20. Guard 23 protects the hand of the operator, as well as prevents inadvertent actuation of lever 21. When lever 21 is compressed, actuator 22 is operated to turn switch 30 to an on position. This energizes the electrical controls for remote control valve 25, allowing ultra high pressure water to flow through valve 25 and into pipe 11. The water is discharged through nozzle assembly 16 in a generally flat high pressure stream to a selected location.

Figure 2:
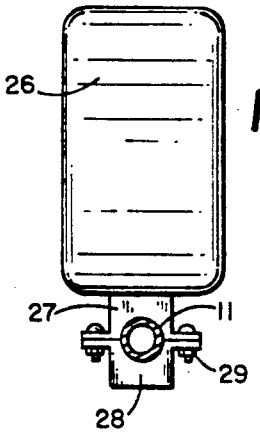
FIG. 2 is an enlarged sectional view taken along line 2—2 of FIG. 1.

The reaction force of the ultra high pressure water discharged from nozzle assembly 16 is absorbed by the body of the operator through shoulder rest 26. As seen in FIGS. 1 and 2, shoulder rest 26 has a generally rectangular configuration with a broad concave rear surface that is adapted to engage the shoulder of the operator. The center portion of the front of shoulder rest 26 is connected to a downwardly directed arm 27. The lower end of arm 27 is attached to pipe 11 with a clamp 28 seen in FIG. 2. A plurality of nut and bolt assemblies 29 secure clamp 28 to the lower end of arm 27. The nut and bolt assemblies 29 allow shoulder rest 26 to be adjusted along the length of pipe 11 from trigger mechanism 18 to the inlet end of the pipe. This adjustment allows for a comfortable positioning of the shoulder rest on the operator and a proper spatial relationship between shoulder rest 26 and trigger mechanism 18.

Figure 4:
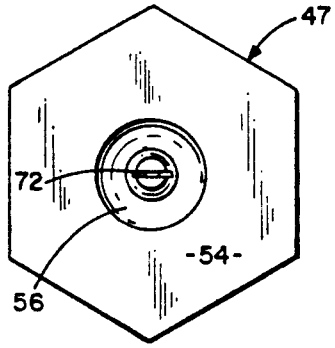
FIG. 4 is an enlarged end view of the lance taken along line 4—4 in FIG. 3 looking in the direction of arrows.
Figure 3:
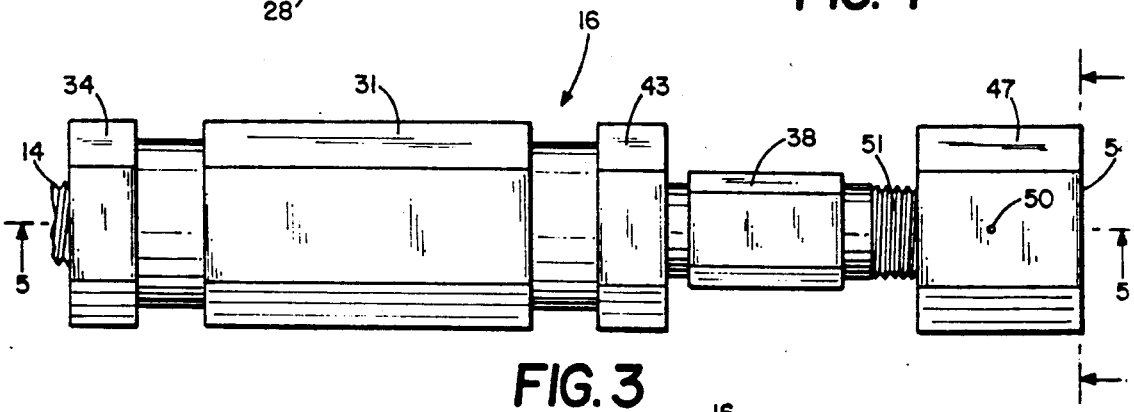
FIG. 3 is an enlarged side view of the nozzle assembly of the lance of FIG. 1.
Figure 5:
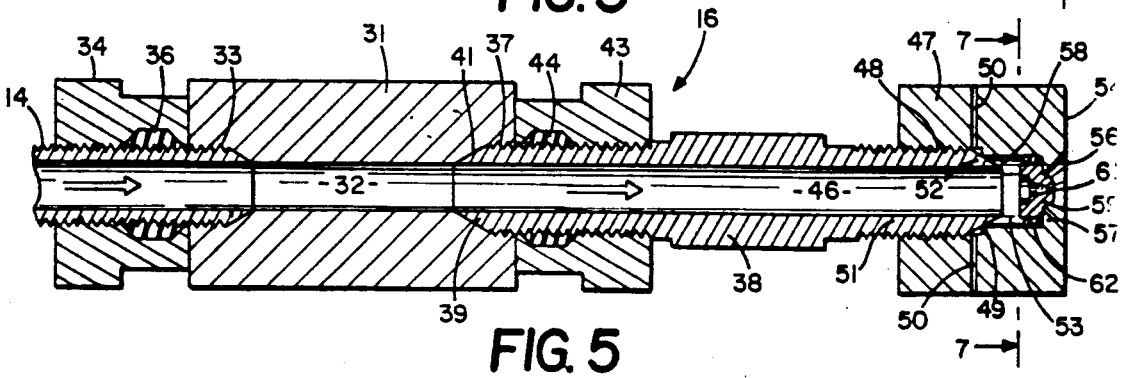
FIG. 5 is a sectional view taken along line 5—5 of FIG. 3.

Referring to FIGS. 3, 4 and 5, nozzle assembly 16 has a coupling 31 with a longitudinal passage 32 for carrying water under ultra high pressure from pipe 11 through a nipple 38 carrying a nozzle head 47. Coupling 31 has an inlet threaded end 33 adapted to receive the threads of the outlet end 14 of pipe 11. A nut 34 having an annular seal 36 is threaded about end 14 and forced into an engagement with the end of coupling 31. The opposite end of coupling 31 has a threaded outlet end 37 for receiving threaded end 39 of nipple 38. End 39 has a cone-shaped surface positioned in tight engagement with a cone seat 41, forming a seal between the end of nipple 38 and coupling 31. A nut 43 carrying an annular seal 44 is threaded onto coupling 38 and engages the end of nipple 31 to lock and seal nipple 38 onto coupling 31. The outlet end of nipple 38 has a threaded end 51 that is threaded into a threaded bore 48 of the nozzle head 47. Threaded bore 48 terminates in a seat 49 that is in tight engagement with a cone end 52 of nipple 38 to mount head 47 in sealing relationship with nipple 38. Seat 49 has a circular right angle edge that forms a crush seal with cone end 52. Transverse bores 50 bleed liquid from the area around cone end 52. Head 47 has an internal chamber 53 formed by a cylindrical inside wall 58 having a diameter larger than passage 46 of nipple 38. The outer forward end of head 47 has a flat front face 54 with a central cone-shaped recess 56 concentric with chamber 53. An annular lip 57 forms the inner portion of recess 56 and provides an annular shoulder for a fan tip 59.

Figure 7:
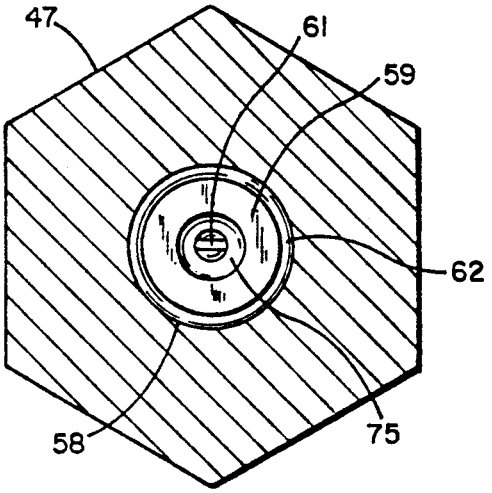
FIG. 7 is an enlarged sectional view taken along line 7—7 of FIG. 5.
Figure 8:
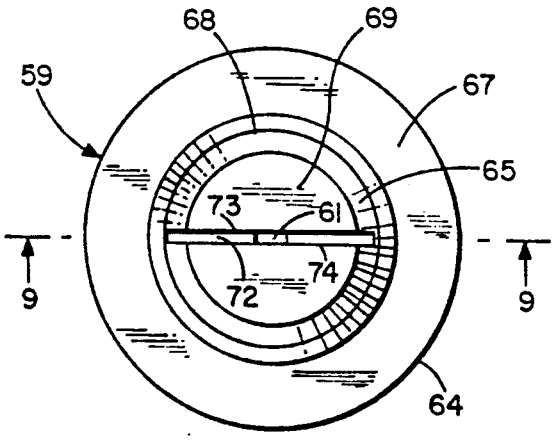
FIG. 8 is an end view of the outer end of the fan tip.

Fan tip 59 has a body 63 located in chamber 53. An annular holder 62, shown as an O-ring, surrounds body 63 to hold fan tip 59 on head 47. O-ring 62 is an annular, compressible plastic or rubber member that is deformed and under compression to hold fan tip 59 in the forward end of chamber 58 of head 47. O-ring 62 centers fan tip 59 in chamber 53 and allows fan tip 59 to be removed and replaced with another tip. As shown in FIGS. 7 and 8, fan tip 59 has an elongated, generally flat orifice 61 which directs a generally flat stream of ultra high pressure water away from head 47 toward a selected location, such as a floor, street, walk, wall and the like.

Figure 6:
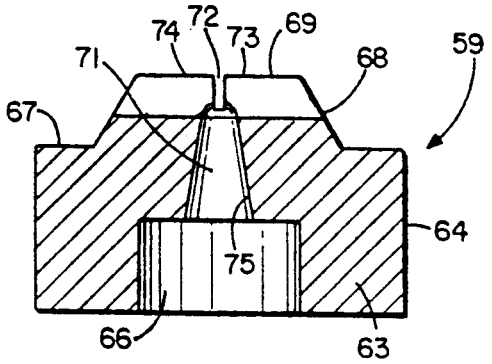
FIG. 6 is an enlarged cross-sectional view of the fan tip shown in FIG. 5.
Figure 9:
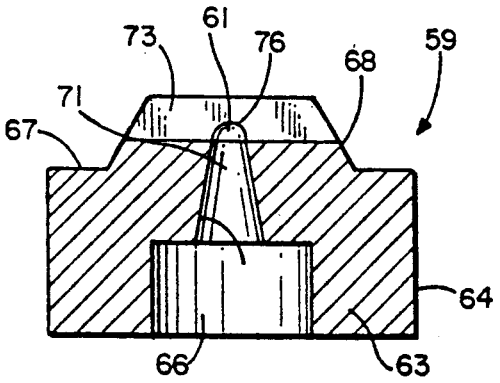
FIG. 9 is a sectional view taken along line 9—9 of FIG. 8.
Figure 10:
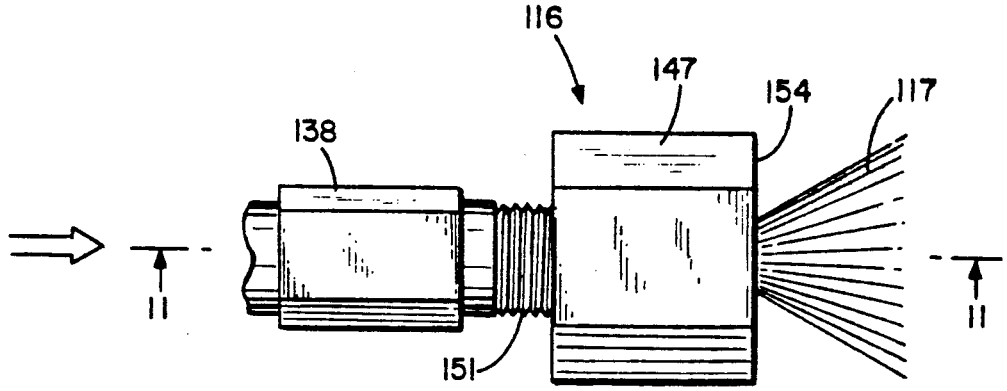
FIG. 10 is a plan view of a nozzle assembly on the forward end of a lance equipped with a modification of the fan tip.

Referring to FIGS. 6, 8 and 9, fan tip 59 has a metal base or body 63 with a smooth, cylindrical outer surface 64. The proximal end of body 63 has a central cylindrical bore 66 adapted to face chamber 53. The distal end of body 63 has an annular transverse shoulder 67 surrounding a forwardly projected truncated boss 68. The outer face 69 of boss 68 is flat. The central interior part of body 63 and boss 68 has a cone-shaped recess or passage 71 open to bore 66 and orifice 61. The wall 75 of body 63 forming recess 71 tapers in a forward direction and intersects a mid-portion of a transverse slot 72 extended diametrically across boss 68, as seen in FIG. 8. The opening or orifice 61 is located in the mid-portion of slot 72. Slot 72 has a uniform width along its length that is smaller than the diameter of the rounded outlet end 76 of passage 71. The length of wall 75 in the longitudinal direction is greater than the diameter of the inlet end of passage 71. For example, the length of wall 75 can be twice the diameter of the inlet end of passage 71. The entire wall 75 is ground smooth to remove burrs and like projections to reduce material erosion due to ultra high pressure water flowing through passage 71. Laterally spaced, generally trapezoidal shaped side walls 73 and 74 are parallel to each other to form transverse slot 72 with a uniform width throughout its length. The uniform width of slot 72 is preferably one half the diameter of outer end 76 of passage 71. The height of slot 72 is greater than the diameter of the outer end 76 of passage 72. Preferably, the height of slot 73 is twice the diameter of the outer end 76 of passage 71. Side walls 73 and 74 restricts the lateral expansion of stream 17 moving from orifice 61. Wall 75 has a maximum 20 degree taper from its center line and terminates in a generally spherical upper or distal end 76. The distal end 76 of passage 71 is intersected with slot 72 to form orifice 61 in layer 65.

Fan tip body 63 is preferably made of high strength material, such as stainless steel, having a Rockwell hardness of 58 to 60. Other types of durable high strength material that are not corrosive to water and are not readily eroded by rapidly moving, ultra high pressure water can be used for body 63. A super hard layer having the orifice can be bonded to body 63. This layer 65 is a hard wear resistant material including, but not limited to, polycrystalline diamond, cubic boron nitride, BORAZON, and Pyrolite carbon.

Referring to FIGS. 10 to 13, there is shown a modification of the nozzle assembly of the invention indicated generally at 116. Nozzle assembly 116 establishes a generally flat stream or curtain of ultra high pressure water that can be directed to selected locations by the operator of the tool. Nozzle assembly 116 is mounted on a manual operated tool such as tool 10 shown in FIG. 1. Other types of tools and machines accommodating ultra high water pressure can be used with nozzle assembly 116. A stream of water 117 is discharged as a generally flat pattern forwardly from nozzle assembly 116. The stream has generally uniform water distribution to provide high quality flow that efficiently uses the pumping energy that generates the ultra high pressure of the water.

Figure 11:
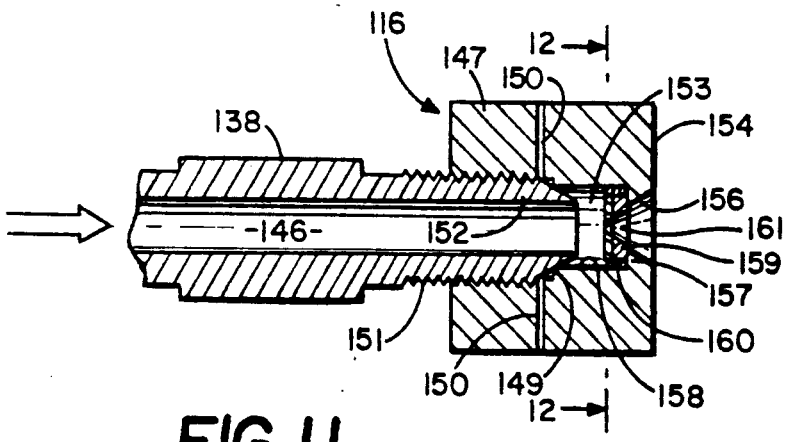
FIG. 11 is an enlarged sectional view taken along the line 11—11 of FIG. 10.

Nozzle assembly 116 is connected with nipple 138 to the tool. Nipple 138 has a threaded end 151 and a central elongated passage 146 as seen in FIG. 11. Nozzle assembly 116 has a head 147 that is threaded on threaded end 151. Head 147 has an annular wall or bore 158 surrounding a chamber 153. Wall 158 has an outwardly directed step having a annular edge 149. The forward end of nipple 138 has a forwardly directed cone 152 located in tight engagement with the edge 149 when head 147 is threaded on threads 151. Edge 149 forms a seat that provides a crush seal with cone 152. Transverse bores 150 bleed liquid from the area around cone end 152. The forward end of head 147 has a flat front face 154 with a central cone-shape recess 156 concentric with chamber 153. An annular lip 157 forms the inner portion of recess 156 and provides a annular shoulder for a fan tip 159.

Figure 12:
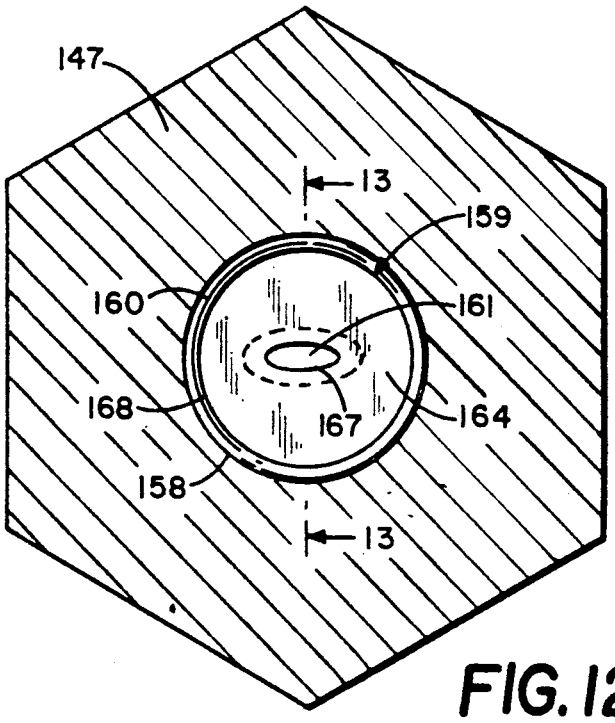
FIG. 12 is an enlarged sectional view taken along line 12—12 of FIG. 11.

Fan tip 159 is retained in chamber 153 with an annular holder 160, such as an O-ring, that is deformed and under compression. As shown in FIG. 12, annular member 160 surrounds outer peripherial surface 168 of fan tip 159 and engages cylindrical wall 158 of head 147 surrounding chamber 153.

Fan tip 159 has a cylindrical base 162, such as stainless steel or carbide, and a layer 163 of super hard material. The super hard material is abrasion resistant and non-corrosive to water and air. Examples of super hard materials inculde polycrystalline diamond, cubic boron nitride, and BORAZON. Other hard materials can be used as layer 163 of super hard material. The super hard layer 163 is bonded to the one side of base 162. Fan tip 159 can be formed by assembling fine diamond powder and carbide into a refractory type mold. The assembly is then subjected to pressures that are near one million psi and heated by electrical current to about 3,000 degrees F. The mold is then allowed to cool and the pressure released. Under these conditions the individual diamond crystals sinter together to form a solid mass.

Figure 13:
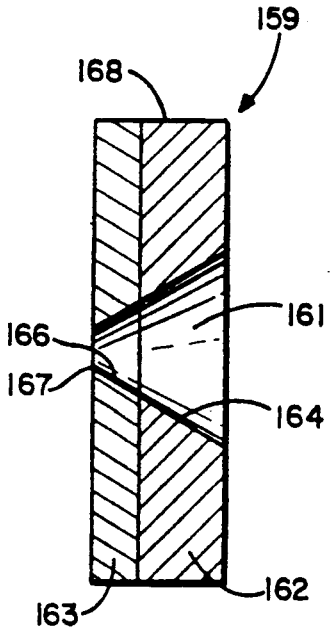
FIG. 13 is a sectional view taken along line 13—13 of FIG. 12.
Figure 15:
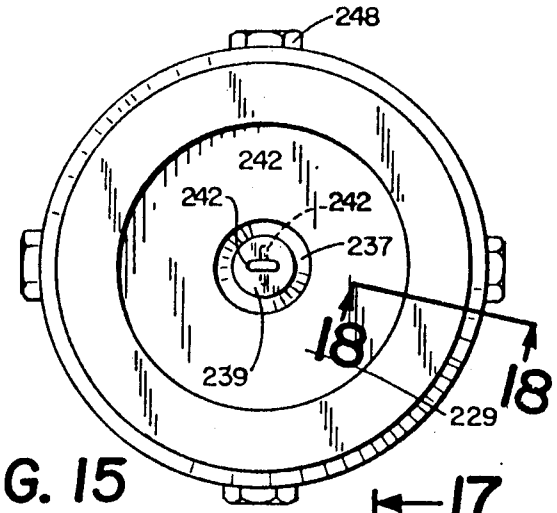
FIG. 15 is a front view of the nozzle assembly of FIG. 14.
Figure 14:
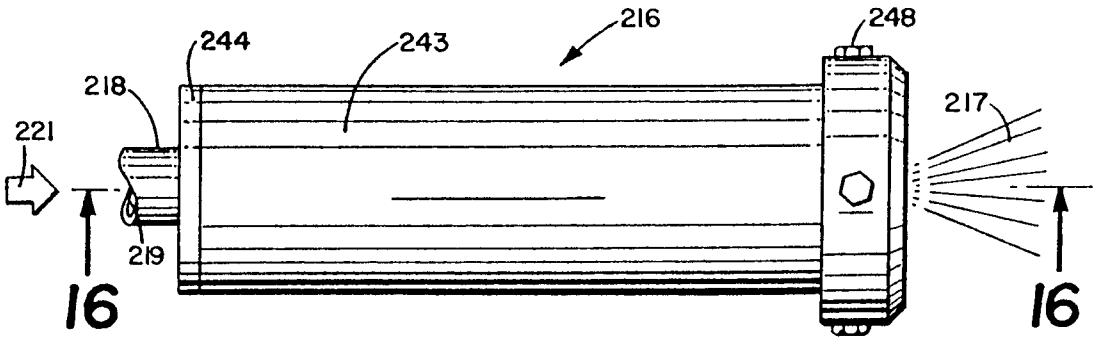
FIG. 14 is a plan view of a second modification of the nozzle assembly equipped with a fan tip.
Figure 16:
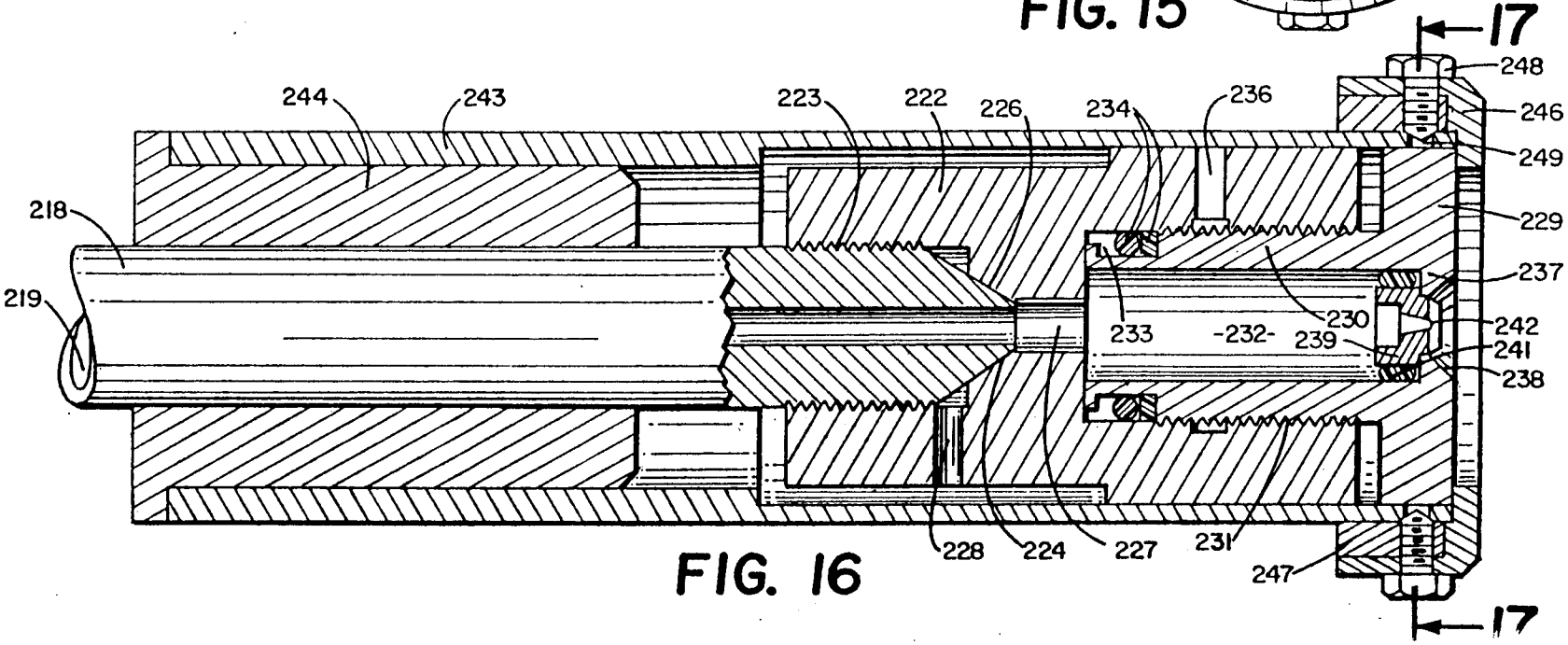
FIG. 16 is an enlarged sectional view taken along line 16—16 of FIG. 14.

An elongated generally oval slot or orifice 161 is cut in base 162 and layer 163 with an EDM wire cutting procedure. The side wall 164 of the orifice, as shown in FIG. 13, tappers outwardly in the forward direction providing the super hard material with an acute angled edge 167 surrounding the inlet of orifice 161. Super hard material of layer 163 being extremely abrasive resistant maintains the shape of edge 167 thereby sustains the shape of the inlet end of orifice 161 for a prolonged period of use. The results are an improved generally flat stream quality, a more efficient use of the energy of the pumping system, uniform distribution of water flow over the width of stream 117 of water, and long wear life of fan tip 159. The stream 117 of water does not have concentrated energy areas whereby the cleaning and scarifying action is uniform over the entire width of stream 117 of water.

Referring to FIGS. 14 to 18, there is shown a second modification of the nozzle assembly of the invention indicated generally at 216. Nozzle assembly 216 generates a generally flat stream or curtain of ultra high pressure water that can be directed to selected locations by the operator of the tool. The stream is angularly adjustable to provide the operator with additional control during the use of the nozzle assembly. Nozzle assembly 216 can be mounted on a manually operated tool such as tool 10 shown in FIG. 1. Other types of tools and machines accommodating ultra high water pressure can be used with nozzle assembly 216. The high pressure stream of water 217 is discharged as a generally flat pattern having uniform water distribution to provide high quality flow that efficiently utilizes the pumping energy that generates the ultra high pressure of the water.

Nozzle assembly 216 is secured to a pipe 218 having a passage 219 for receiving ultra high pressure water indicated by arrow 221. Nozzle assembly 216 has a body 222 having a threaded bore 223. The base of the bore has a cone recess face 224 that accommodates conical end 226 of pipe 218. Pipe 218 is threaded into the threaded bore 223 to hold conical end 226 in sealing relation with cone recess face 224. A transverse bore 228 bleeds the liquid from the area around cone end 226. The end of pipe 218 is aligned with a passage 227 in body 222 leading to a chamber 232 of a head 229.

Head 229 has a cylindrical threaded stem 230 surrounding passage 232. Stem 230 is turned into a threaded bore 231 in the outer end of body 222. The outer end of stem 230 has an annular groove 233 accommodating annular seals 234 located in engagement with the inner end of bore 231. Base 222 has a transverse port 236 open to the side of stem 230 to collect fluid that may bypass seals 234.

Head 229 has an inwardly directed annular lip 237 surrounding a discharge opening 238. Annular lip 237 forms the inner portion of the chamber 232 and provides an annular shoulder for a fan tip 239. Fan tip 239 is an annular member having the structure of fan tip 59 as shown in FIGS. 6, 8 and 9. Fan tip 159 shown in FIG. 13 can be used with head 229. An annular member or O-ring 241 retains fan tip 239 in chamber 232 in engagement with annular lip 237. Fan tip 239 has a slot discharge orifice 242 which reduces the concentration of energy areas so that the cleaning and scarifying action of the stream of water 217 is substantially uniform over its entire width. As shown in full and broken lines in FIG. 15, the angular orientation of orifice 242 can be changed.

A sleeve 243 surrounds body 222 and head 229. A cylindrical collar 243 rotatably mounts sleeve 244 on pipe 218 adjacent body 222. The outer end of sleeve 243 is rotatably mounted on body 222. An annular cap 246 is mounted on the outer end of sleeve 243. Cap 246 surrounds a ring 247 located in surface engagement with the end of sleeve 243. Ring 247 can be integral with cap 246. A plurality of bolts 248 threaded through cap 246 extended into holes 249 in sleeve 243 hold head 229 in assembled relation with sleeve 243.

Figure 17:
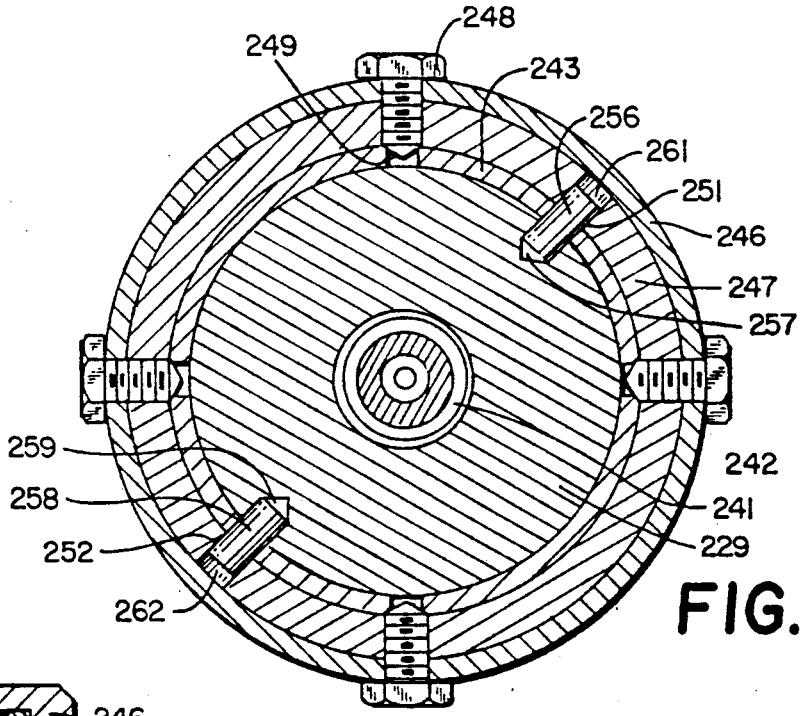
FIG. 17 is a sectional view taken along line 17—17 of FIG. 16.
Figure 18:
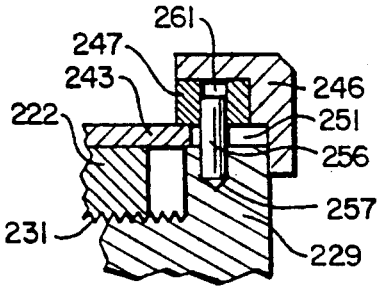
FIG. 18 is a sectional view taken along line 18—18 of FIG. 15.

A shown in FIG. 17, the outer end of sleeve 243 has two circumferentially placed space slots 251 and 252. A first pin 256 located in a bore 257 in head 229 projects through slot 251 into a hole 261 in ring 247. A second pin 258 is located in a bore 259 in head 229 diametrically opposite pin 256. Pin 258 extends through slot 252 and into a hole 262 in ring 247. Pins 256 and 258 connect head 229 with the cap 246 and ring 247. Cap 246 and head 229 can be rotated to longitudinally move head 229 relative to body 222 to turn fan tip 239 thereby changing the angular position of discharge orifice 242 as shown in broken lines in FIG. 15. Sleeve 243 can be rotated thereby rotating cap 246 and head 229 during use of nozzle assembly 216 as the sleeve extends rearwardly of body 222 so that the operator can turn the sleeve remote from the high pressure stream of water discharging from the fan tip.

Figure 19:
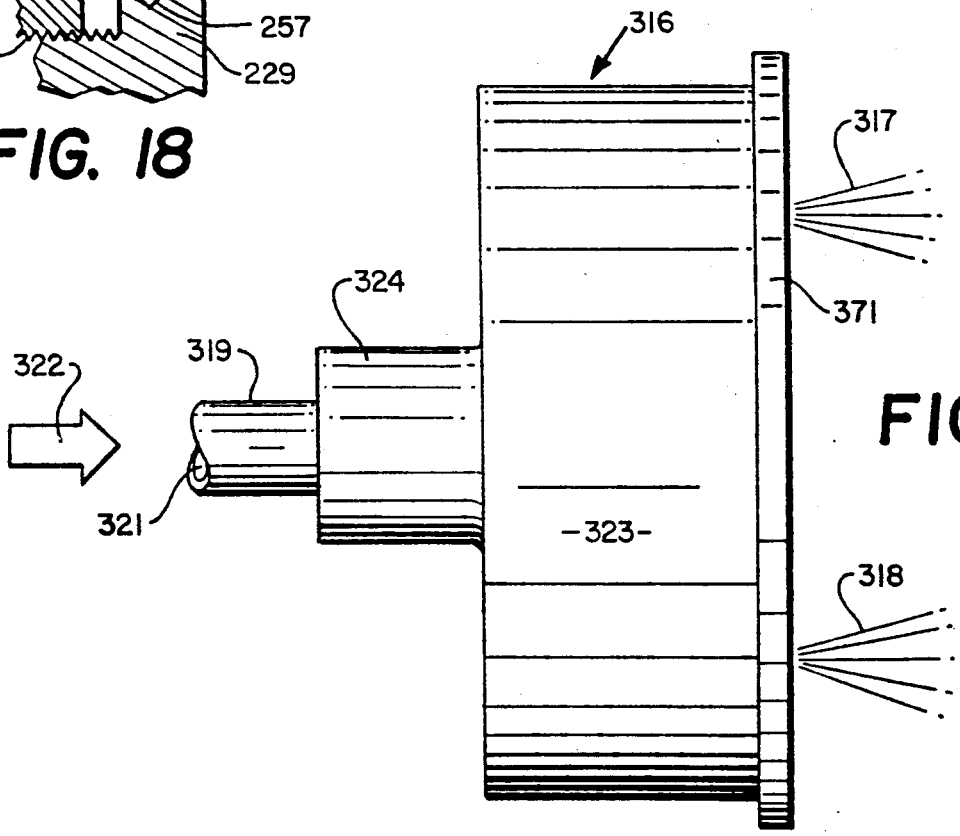
FIG. 19 is a third modification of the nozzle assembly equipped with a pair of fan tips.
Figure 20:
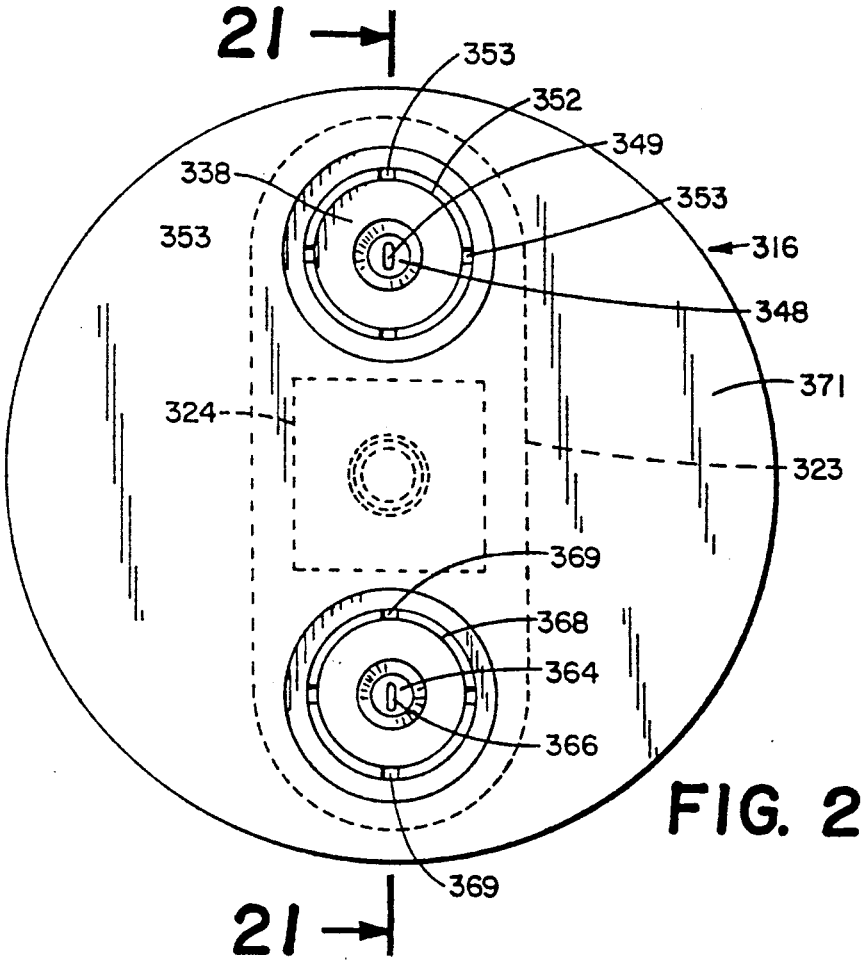
FIG. 20 is a front view of the nozzle assembly of FIG. 19.
Figure 21:
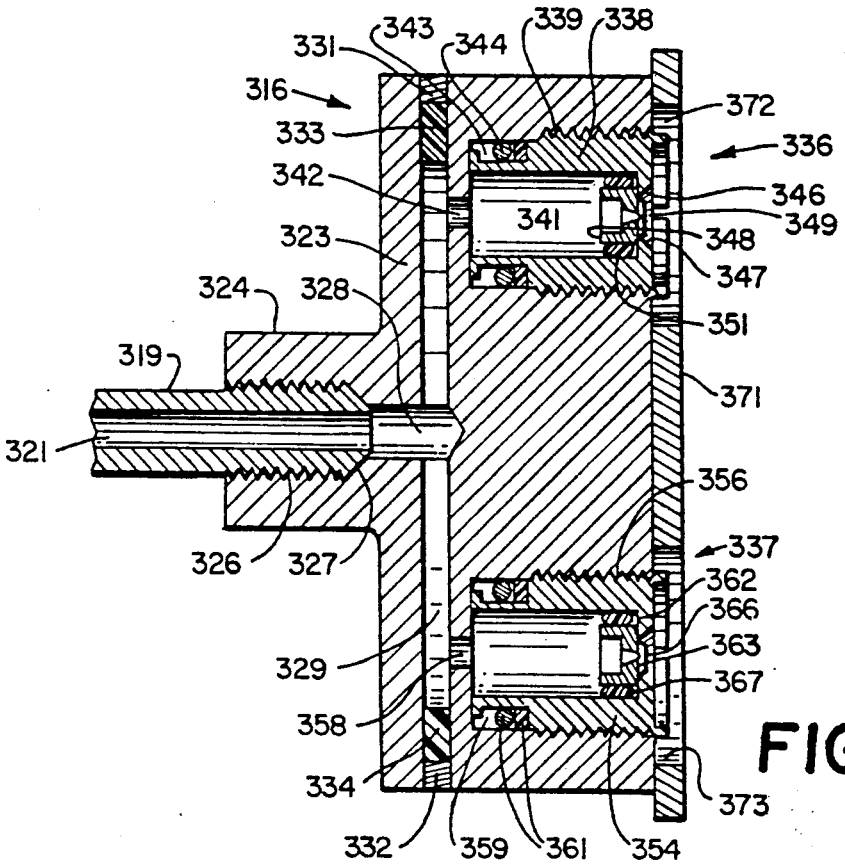
FIG. 21 is a sectional view taken along line 21—21 of FIG. 20.

Referring to FIGS. 19 to 21, there is shown a third modification of the nozzle assembly of the invention indicated generally at 316. Nozzle assembly 316 discharges a pair of ultra high pressure streams of water 317 and 318 to a desired location. The nozzle assembly 316 can be rotated whereby streams 317 and 318 move in a circular pattern over a surface. Nozzle assembly 316 is connected to a pipe 319 having a passage 321 for delivering a ultra high pressure water indicated by arrow 322 to nozzle assembly 316. Pipe 319 can be pipe 11 as shown in FIG. 1.

Nozzle assembly 316 has a generally flat body 323 having a lateral boss 324. Boss 324 has a threaded bore 326 accommodating a threaded end of pipe 319. As seen in FIG. 21, the end of pipe 319 has a cone surface located in sealing relation with a cone face 327 at the base of boss 324. Body 323 has an axial bore 328 open to the passage 321 in pipe 319 and connected to a transverse or radial passage 329. The ends of passage 329 are closed with plugs 331 and 332 to retain seals 333 and 334 in passage 329. Body 323 carries a pair of nozzle units indicated generally at 336 and 337. Nozzle unit 336 has a sleeve 338 located within a threaded bore 339 of body 323. Sleeve 338 has an internal chamber 341 connected with a port 342 to passage 329. The inner portion of sleeve 338 has a groove 343 accommodating a seal assembly 344. The outer end of sleeve 338 has an inwardly directed annular lip 346 surrounding an openning 347 and forming a shoulder for a fan tip 348. Fan tip 348 has a generally slot discharge orifice 349. Fan tip 348 is the same as the fan tip 59 as shown in FIGS. 6, 8 and 9. Fan tip 159 as shown in FIGS. 12 and 13 can be used in lieu of fan tip 348. An O-ring or annular member 351 surrounding fan tip 348 retains the fan tip in passage 341 adjacent annular lip 346.

Sleeve 338 has an annular outwardly directed rim 352 having a plurality of slots 353 for accommodating a tool used to turn sleeve 338 into the threaded bore 339. The angular orientation of slot discharge orifice 349 can be changed by turning sleeve 338.

Body 323 has a second threaded bore 356 accommodating a sleeve 354 of nozzle unit 337. Sleeve 354 has a chamber 357 connected with port 358 to passage 329. The inner end of sleeve 354 has an annular groove 359 accommodating a seal assembly 361. The outer end of sleeve 354 has an inwardly directed annular lip 362 surrounding an opening 363 and providing a shoulder for supporting a fan tip 364. Fan tip 364 is identical to the fan tip 348 and the fan tip 59 as shown in FIGS. 6, 8 and 9. Fan tip 364 has a slot discharge orifice 366. An annular member or O-ring 367 surrounds fan tip 364 and retains the fan tip 364 in engagement with the annular lip 362.

Sleeve 354 has an outwardly directed annular rim 368 having a plurality of circumferentially spaced slots 369. A turning tool has projections that are located in the slots to permit the turning of the sleeve 354 into threaded bore 356. The angular orientation of slot discharge orifice 366 can be changed by turning sleeve 354.

A circular plate 371 is secured to the outer end of body 323. As shown in FIGS. 20 and 21 plate 371 has a pair of circular openings 372 and 373 that surround the outer ends of sleeves 338 and 354. Plate 371 serves as a guide and protection member for base 323 and nozzle units 336 and 337 during use of nozzle assembly 316.

In use, a turning tool is used to remove sleeves 338 and 354 from body 323. The tool has teeth that fit into slots 353 and 369 so that sleeves 338 and 354 can be turned out of body 323. The fan tips 348 and 364 can then be removed and replaced with new fan tips. The fan tips 348 and 364 are forced out of the chambers 341 and 357. The new fan tips are then reinserted into the chambers 341 and 357 and retained therein with O-rings 351 and 367. The tool is then used to turn sleeves 338 and 354 back into body 323 as shown in FIG. 21. The nozzle assembly 316 is used with the ultra high water pressure to clean and scarify a surface of foreign materials. Nozzle assembly 316 can be rotated about the axis of passage 328 to move nozzle units 336 and 337 in a circular path. Movement of nozzle assembly 316 as it is rotating relative to a surface will clear a path on the surface.

Modifications of the structure and materials of the tool, nozzle assemblies, and fan tips may be made without departing from the invention. The invention is defined in the following claims.

I claim:

1. A tool for directing a generally flat stream of water under pressure of at least 25,000 psi to a selected location comprising: an elongated tubular means having an inlet end, and outlet end, and a passage connecting said inlet and outlet ends for accommodating water under pressure of at least 25,000 psi, a solenoid operated valve for controlling the flow of water to said inlet end of the tubular means positioned at a location remote from the tubular means, hose means connecting the valve to the inlet end of the tubular means, trigger means connected to the tubular means having a switch electrically coupled to the solenoid operated valve, and a lever operable to actuate the switch whereby when the lever is moved to actuate the switch the solenoid operated valve is opened to allow water to flow to the tubular means, and when the lever is released the switch operates to deenergize the solenoid operated valve to close said valve thereby blocking the flow of water to the tubular means, a nozzle assembly connected to the outlet end of the tubular means for directing a generally flat stream of water to the selected location, said nozzle assembly having a head mounted on the outlet end of the tubular means, said head having an inside wall surrounding a chamber open to said passage for receiving the ultra high pressure water from said passage, a discharge opening, open to the chamber, and an annular inwardly directed lip between the chamber and discharge opening, a fan tip located in said chamber adjacent said discharge opening for directing a generally flat stream of ultra high pressure water to a selected location, an annular compressible holder surrounding the fan tip engageable with the inside wall of the head holding the fan tip on said head adjacent said discharge opening, said fan tip having a body with a passage substantially smaller in diameter than said chamber, said body having an annular shoulder located in engagement with the lip and a boss projected into the discharge opening, a transverse slot between parallel inside walls in the boss intersecting the passage in the body forming a discharge orifice allowing ultra high pressure water to flow from the passage into the slot whereby the orifice and slot confine the ultra high pressure water to a generally flat stream of ultra high pressure water and directs the stream of ultra high pressure water to a selected location.

2. The tool of claim 1 including: shoulder rest means connected to the tubular means adapted to engage the body of a person to stabilize the tool.

3. The tool of claim 2 wherein: the trigger means extends in a general downward direction, and the shoulder rest means extends a general upward direction.

4. The tool of claim 1 wherein: the passage in the fan tip has a cone shape and converges in the direction of the flow of water through the passage in the fan tip to the discharge orifice.

5. The tool of claim 1 wherein: the fan tip has a layer of super hard material, said slot and orifice extending through said layer of super hard material.

6. The tool of claim 5 wherein: the supper hard material is a class of material including polycrystalling diamond, cubic boron nitride, and borazon.

7. The tool of claim 1 wherein: the fan tip has a body with an outer cylindrical surface, said annular holder surrounding with cylindrical surface.

8. The tool of claim 7 wherein: the transverse slot has substantially uniform width, said width of the slot being being the same as than the diameter of the outer end of passage in the fan tip.

9. A tool for directing a stream of water under pressure of at least 25,000 psi to a selected location comprising: tubular means having an inlet end, an outlet end, and a passage connecting said inlet and outlet ends for accommodating water under pressure of at least 25,000 psi, solenoid operated valve means for controlling the flow of the water to said inlet end of the tubular means positioned at a location remote from the tubular means, means connecting the valve means to the inlet end of the tubular means for carrying water to the tubular means, trigger means connected to the tubular means having a switch electrically coupled to the solenoid operated valve means, and moveable means operable to actuate the switch whereby when the moveable means is moved to actuate the switch the solenoid operated valve means is opened to allow the water to flow to the tubular means, and when the moveable means is released the switch operates to deenergize the solenoid operated valve means to close said valve means thereby blocking the flow of the water to the tubular means, a nozzle assembly connected to the oulet end of the tubular means for directing a stream of water to the selected location, said nozzle assembly having a head including an inside wall surrounding an internal chamber open to said passage for receiving ultra high pressure water, a discharge opening open to the chamber and atmosphere, and an inwardly directed lip located between the chamber and discharge opening, a fan tip located in said chamber, annular compressible means surrounding the fan tip and engageable with said inside wall for holding the fan tip on the head, said fan tip having a body with a passage open to the chamber, said body having an annular shoulder located in engagement with the lip and a boss projected into the discharge opening, a transverse slot between parallel inside walls in the boss intersecting the passage in the body forming a discharge orifice allowing ultra high pressure water to flow from the passage in the body into the slot whereby the orifice and slot confine the ultra high pressure water to a generally flat stream of ultra high pressure water and directs the stream of ultra high pressure water to a selected location.

10. The tool of claim 9 wherein: the fan tip has a layer of super hard material, said orifice extending through said layer of super hard material.

11. The tool of claim 10 wherein: the super hard material is a class of material including polycrystalling diamond, cubic boron nitride, and borazon.

12. The tool of claim 9 including: shoulder rest means connected to the tubular means adapted to engage the body of a person to stabilize the tool.

13. The tool of claim 12 wherein: the trigger means extends in a general downward direction, and the shoulder rest means extends a general upward direction.

14. The tool of claim 9 wherein: the fan tip has a body with an outer cylindrical surface, said annular compressible means surrounding said cylindrical surface.

15. The tool of claim 9 wherein: the passage in the fan tip has a cone shape and converges in the direction of the flow of water through the passage in the fan tip.

16. The tool of claim 14 wherein: the transverse slot has substantially uniform width, said width of the slot being the same as the diameter of the outer end of passage in the fan tip.

17. The tool of claim 14 wherein: the fan tip has a layer of super hard material, said slot and orifice extending through said layer of super hard material.

18. The tool of claim 14 including: the passage in the fan tip has a cone shape and converges in the direction of the flow of water through the passage in the fan tip to the discharge orifice.

19. The tool of claim 14 wherein: the fan tip has a layer of super hard material, said orifice extending through said layer of super hard material.

20. The tool of claim 16 wherein: the super hard material is a class of material including polycrystalling diamond, cubic boron nitride, and borazon.

21. A tool for directing a generally flat stream of water under pressure to a selected location comprising: a tubular means having an inlet end, and outlet end, and a passage connecting said inlet and outlet ends for accommodating water under pressure, and a nozzle assembly connected to the outlet end of the tubular means for directing a generally flat stream of water under pressure to the selected location, said nozzle assembly having a head including an inside wall surrounding an internal chamber open to said passage for receiving water under pressure, an external discharge opening open to the chamber, and an inwardly directed lip between the chamber and the discharge opening, a fan tip located in said chamber adjacent said discharge opening for directing a generally flat stream of water to a selected location, annular compressible means surrounding the fan tip and engageable with the inside wall of the head holding the fan tip on the head, said fan tip having a body with a passage open to the chamber, said body having an annular shoulder located in engagement with the lip and a boss projected into the discharge opening, a transverse slot between inside walls in the boss intersecting the passage in the body forming a discharge orifice allowing high pressure water to flow from the passage into the slot whereby the orifice and slot confine the water to a generally flat stream of high pressure water and directs the stream of high pressure water to a selected location.

22. The tool of claim 21 wherein: the body of the fan tip has an outer cylindrical surface, said annular compressible means surrounding said cylindrical surface.

23. The tool of claim 22 wherein: the passage in the fan tip has a cone shape and converges in the direction of the flow of water through the passage in the fan tip.

24. The tool of claim 22 wherein: the transverse slot has substantially uniform width, said width of the slot being the same as the diameter of the outer end of passage in the fan tip.

25. The tool of claim 22 wherein: the fan tip has a layer of super hard material, said slot and orifice extending through said super hard material.

26. A nozzle assembly for a tool having a member with a passage used to direct water under pressure to a selected location comprising: a head adapted to be mounted on said member for receiving water under pressure from said member, said head having an inside wall surrounding an internal chamber, an external discharge opening open to the chamber, and an annular inwardly directed lip between the chamber and discharge opening, a fan tip located in said chamber adjacent said discharge opening for directing a stream of water to a selected location, an annular compressible means surrounding the fan tip engageable with the inside surface of the head to hold the fan tip on the head, said fan tip having a body with a passage open to the chamber, said body having an annular shoulder located in engagement with the lip and a boss projected into the discharge opening, transverse slot means located in said boss intersecting the passage in the body forming a discharge open orifice allowing water under pressure to flow from the passage in the body into the slot means whereby the orifice and slot means directs the stream of water under pressure to a selected location.

27. The nozzle assembly of claim 26 wherein: the passage in the fan tip has a cone shape and converges in the direction of the flow of water though the passage in the fan tip to the discharge orifice.

28. The nozzle assembly of claim 26 wherein: the fan tip has a layer of super hard material, said orifice extending through said layer of super hard material.

29. The nozzle assembly of claim 28 wherein: the super hard material is a class of material including polycrystalling diamond, cubic boron nitride, and borazon.

30. The nozzle assembly of claim 26 wherein: the body of the fan tip has an outer cylindrical surface, said annular compressible means surrounding said cylindrical surface.

31. The nozzle assembly of claim 30 wherein: the passage in the fan tip has a cone shape and converges in the direction of the flow of water through the passage in the fan tip.

32. The nozzle assembly of claim 30 wherein: the transverse slot has substantially uniform width, said width of the slot being the same as the diameter of the outer end of passage in the fan tip.

33. The nozzle assembly of claim 30 wherein: the fan tip has a layer of super hard material, said slot and orifice extending through said super hard material.

34. The nozzle assembly of claim 33 wherein: the super hard material is class of material including polycrystalling diamond, cubic boron nitride, and borazon.

35. The nozzle assembly of claim 33 wherein: the fan tip includes a body, said layer of super hard material being bonded to said body.

36. A nozzle assembly for a tool used to direct a generally flat stream of water under ultra high pressure of at least 25,000 psi to a selected location having a member with a passage connectable to a supply of water under ultra high pressure of at least 25,000 psi characterized by a head mounted on the member, said head having an inside wall surrounding a chamber open to said passage for receiving the ultra high pressure water from said passage, a discharge opening open to said chamber, and an annular inwardly directed lip between the chamber and discharge opening, a fan tip located in said chamber adjacent said discharge opening for directing a generally flat stream of ultra high pressure water to a selected location, and annular compressible means surrounding the fan tip engageable with the inside wall of the head holding the fan tip on said head adjacent said discharge opening, said fan tip having a body with a passage substantially smaller in diameter than said chamber, said body having an annular shoulder located in engagement with the lip and a boss projected into the discharge opening, a transverse slot between parallel inside walls in the boss intersecting the passage forming a discharge orifice allowing ultra high pressure water to flow from the passage into the slot whereby the orifice and slot confine the ultra high pressure water to a generally flat stream of ultra high pressure water and directs the stream of ultra high pressure water to a selected location.

37. The nozzle assembly according to claim 36 characterized by the passage in the fan tip having a cone shaped inside wall that converges in the direction of the flow of water through the passage to the discharge orifice.

38. The nozzle assembly of claim 36 characterized by the fan tip having a layer of super hard material, said orifice extending through said layer of super hard material.

39. The nozzle assembly of claim 36 characterized by the transverse slot having substantially uniform width, said width of the slot being the same as the width of the orifice.

40. The nozzle assembly according to claim 36 characterized by a sleeve mounted in threaded assembled relation on the member, and means securing the head to the sleeve whereby when the head is rotated relative to the sleeve, the head turns to adjust the angular orientation of the slot and discharge orifice.

41. The nozzle assembly according to claim 36 characterized by a solenoid operated valve for controlling the flow of water to said member, positioned at a location remote from the member, hose means connecting the valve to the member having a switch electrically coupled to the solenoid operated valve, and a lever operable to actuate the switch so that the solenoid operated valve is opened to allow water to flow to the member, and when the lever is released the switch operates to deenergize the solenoid operated valve to close said valve thereby blocking the flow of water to the member head and fan tip.

42. The nozzle assembly according to claim 41 characterized by a shoulder rest connected to the member adapted to engage the body of a person to stabilize the tool.

43. The nozzle assembly according to claim 41 characterized by the trigger means extends in a general downward direction, and the shoulder rest extends a general upward direction.

* * * * *